US006128910A

United States Patent [19]

Faircloth

[11] Patent Number: 6,128,910

[45] Date of Patent: Oct. 10, 2000

[54] DIAGNOSTIC UNIT FOR AN AIR CONDITIONING SYSTEM

[75] Inventor: John E. Faircloth, Jacksonville, Fla.

[73] Assignee: Federal Air Conditioning Technologies, Inc., Calexico, Calif.

[21] Appl. No.: 08/914,475

[22] Filed: Aug. 19, 1997

Related U.S. Application Data

[60] Provisional application No. 60/037,364, Feb. 6, 1997.

[51] Int. Cl.[7] ..... F24B 49/02

[52] U.S. Cl. ..... 62/129; 62/127

[58] Field of Search ..... 62/125, 126, 127, 62/129, 130, 176.6; 236/94, 44 C; 165/11.1, 11.2, 251

[56] References Cited

U.S. PATENT DOCUMENTS

| | | | |
|---|---|---|---|
| 4,510,576 | 4/1985 | MacArthur et al. | 62/129 X |
| 4,611,470 | 9/1986 | Enström | 62/129 X |
| 4,885,914 | 12/1989 | Pearman | 62/129 |

OTHER PUBLICATIONS

Chapter 5, "Psychrometrics" from the ASHRAE Handbook of Fundamentals, consisting of 5 pages.

Copy of psychometric chart by Trane and Directions for using the Trane Psychrometric Chart, 2 pages.

Basic part of final program of the fundamental computations, 2 pages.

*Primary Examiner*—Harry B. Tanner

*Attorney, Agent, or Firm*—Nydegger & Associates

[57] ABSTRACT

An apparatus and method for noninvasively diagnosing a closed air refrigeration system includes a sensing unit which can be selectively placed over the evaporator inlet duct and the evaporator outlet duct to respectively measure the evaporator inlet enthalpy and the evaporator outlet enthalpy. Using both of these enthalpies, a computer calculates a sensible heat ratio for the evaporator which is useable to diagnose the system. Similarly, the sensing unit can be selectively placed over the condenser intake and condenser exhaust to measure the condenser intake enthalpy and the condenser exhaust enthalpy. Using these enthalpies, the computer calculates a sensible heat ratio for the condenser which is useable to further diagnose the system. Further, superheat and subcool set points can be calculated and compared with rated set points to evaluate the system. In an alternate embodiment, separate sensing units can be used simultaneously to measure the various enthalpies.

23 Claims, 4 Drawing Sheets

DIAGNOSTIC UNIT FOR AN AIR CONDITIONING SYSTEM

This application claims the benefit of U.S. Provisional Application No. 60/037,364, Filing Date Feb. 6, 1997.

FIELD OF THE INVENTION

The present invention pertains generally to apparatus for diagnosing air conditioning systems. More particularly, the present invention pertains to apparatus which can determine proper functioning of an air conditioning system by using only noninvasive measurements. The present invention is particularly, but not exclusively, useful as either a mobile or a fixed based apparatus which monitors enthalpies at predetermined locations in the air flow associated with an air conditioning system for the purpose of determining and predicting system inefficiencies.

BACKGROUND OF THE INVENTION

Air conditioning systems are typically designed and engineered to obtain specific results by using conventional components which operate within certain predetermined parameters. Specifically, as one essential component, air conditioning systems will include a refrigerant, such as freon, which is repeatedly cycled through a fluid line. Not surprisingly, several processes are involved as the refrigerant is moved through the system.

For an overview of the operation of an air conditioner system, it is helpful to consider one cycle. As a start point for the cycle, consider the refrigerant to be in its gaseous state. During each cycle, the gaseous refrigerant is elevated from a relatively low pressure to a high pressure condition by a compressor. The refrigerant is then passed through a condenser coil where it is condensed at high pressure into a liquid or semi-liquid state. Next, the high pressure liquid refrigerant is passed through an expansion valve which reduces the pressure on the refrigerant. The now low pressure liquid refrigerant is then passed to an evaporator coil where it evaporates, at the low pressure, back into a gaseous state. This completes the cycle. The cycle is then repeated. It is, of course, to be appreciated that the refrigerant completely fills the fluid line and that, at all times, portions of the refrigerant are at various points in the process.

From the user's viewpoint, it is important to note that as the refrigerant evaporates, heat from its surroundings is transferred to the refrigerant. As intended for air conditioning systems, the surroundings from which the heat is transferred is the air that is to be cooled by the system.

Heretofore, whenever it has been desired or necessary to test an air conditioning system for a malfunction or an inefficiency, testing of the system has been primarily a matter of evaluating the condition of the refrigerant in the fluid line of the system. Such an evaluation has required a physical invasion of the fluid line to determine the volume of refrigerant in the system, as well as its pressure and temperature at various points in the fluid line. Obviously, an invasive evaluation of an air conditioning system can be time consuming and, in many instances, quite difficult to perform. Furthermore, it may be unnecessary.

The present invention recognizes that a physical invasion of the fluid line is not necessary for a complete and thorough analysis or evaluation of an air conditioning system. Instead, it is appreciated that an engineering evaluation of a system's component efficiencies can be made by making proper psychrometric analyses. For the present invention, such analyses rely on basic thermodynamic principles.

By definition, enthalpy (H,h) is a thermodynamic property of a working substance which is associated with the study of heat of reaction, heat capacity and flow processes. Mathematically, enthalpy is defined as h=u+pv where u is the internal energy, p the pressure and v the volume of a system. With this in mind, it is important to know that heat (Q,q) is energy that is in the process of transfer between a system and its surroundings. This energy transfer results due to temperature differences. In the context of the present invention, the relationship between enthalpy and heat can be simply stated. Namely, the heat absorbed (or rejected) in a quasistatic isobaric (i.e. constant pressure) process is equal to the difference between the enthalpies of the system in the end states of the process. For example, consider the evaporator coil of an air conditioning system. The heat (q) which is transferred from the surrounding air to the evaporator coil, during a cooling of the air, is equal to the difference between the enthalpies of air at the evaporator inlet ($h_{inlet}$) and at the evaporator outlet ($h_{outlet}$).

$$q=h_{inlet}-h_{outlet}\Delta=h$$

A similar relationship holds for the condenser coil as well.

Due to the fact air conditioning systems are typically engineered so that the refrigerant used will transition between a fluid and a gaseous state, it is helpful to define two different types of heat pertinent to this transition. These are latent heat, which causes the change of state, and sensible heat, which does not. Specifically, latent heat is the heat which is required to change the state of a unit mass of a substance from a solid to a liquid, or from a liquid to a gas. Importantly, latent heat is not measured because it does not involve a change of temperature. Thus, without any change in temperature, the specific latent heat for a state transition is the difference in enthalpies of the substance in its two states. On the other hand, sensible heat is heat which effects a change in the temperature of a body and which is, therefore, detectable by the senses. With these definitions, it is now possible to further define the sensible heat ratio (SHR) as the ratio of latent heat to sensible heat in a process.

Using air tables well known to the skilled artisan, it is possible to determine the enthalpy of an air mass by taking readings of both the relative humidity and the dry bulb temperature of the air mass. For purposes of the present invention, the dry bulb temperature ($T_d$) is taken to be the equilibrium temperature of the air-vapor mixture as indicated by an ordinary thermometer. Further, relative humidity ($\phi$) is taken to be the ratio of the partial pressure of the water vapor in a mixture to the saturation pressure of the vapor at the same temperature. Relative humidity may also be defined as the ratio of the density of the vapor in the mixture to the density of saturated vapor at the same temperature.

As can be easily appreciated, any diagnosis of an air conditioning system will involve evaluating various operational data and comparing this data with standards established by the system manufacturer. Obtaining the proper data, however, can be painstaking and labor intensive.

In light of the above, it is an object of the present invention to provide an apparatus for diagnosing and monitoring a closed air refrigeration system which relies on enthalpy readings and which, therefore, can be used without invasively entering the refrigerant fluid line of the system. It is another object of the present invention to provide an apparatus for non-invasively diagnosing a closed air refrigeration system which can be used in either a mobile or a fixed base configuration for, respectively, making an instantaneous or a continuous evaluation of an air conditioning system. Still another object of the present invention is to provide an apparatus for non-invasively diagnosing a closed air refrigeration system which is easy to use, relatively simple to manufacture and comparatively cost effective.

SUMMARY OF THE PREFERRED EMBODIMENTS

An apparatus for non-invasively diagnosing and monitoring a closed air refrigeration system essentially includes at least one sensing unit and a computer. The sensing unit includes an air flow channel and it has a detector which is mounted on the unit in the air flow channel. Specifically, the detector includes a thermometer for taking the dry bulb temperature ($T_d$) and a relative humidity meter which measures the relative humidity ($\phi$) of air flowing through the air channel. The detector may also include devices for determining volumetric air flow through the sensing unit. These readings, the dry bulb temperature reading, the relative humidity reading and the volumetric flow are electrically or electronically transmitted from the detector to the computer for analysis.

A typical closed air refrigeration system to be monitored by the present invention includes an evaporator and a condenser. Further, the evaporator has an evaporator coil, and it has a blower which directs relatively warm air from the air space that is being refrigerated through an inlet and over the evaporator coil. In this process, heat is transferred from the air to the evaporator coil. Thus, the air is cooled. The evaporator also has an outlet which directs the now-cooled air back into the air space that is being refrigerated. In a somewhat similar arrangement, the condenser of an air conditioning system has a condenser coil which is immersed in a fluid heat sink. Depending on the needs of the system, the heat sink may be either gaseous or liquid. Typically, however, the heat sink is gaseous and the condenser includes a blower which directs air from the outside heat sink through an intake and over the condenser coil. As this air passes over the condenser coil, heat is transferred from the condenser coil to the air. The now-heated air is then passed through an exhaust and back into the heat sink.

As intended for the present invention, both the evaporator and the condenser can be monitored and evaluated by sensing units. For example, to monitor and evaluate the evaporator, a sensing unit is positioned over the evaporator inlet and readings are taken of the dry bulb temperature and relative humidity of the air entering the inlet. As indicated above, the volumetric air flow rate may also be measured. These readings are then transmitted to the computer where they are used to calculate an enthalpy for air entering the evaporator inlet. The sensing unit is then positioned over the evaporator outlet and readings are taken of the dry bulb temperature, the relative humidity, and the volumetric flow rate of the air leaving the outlet. These readings are also transmitted to the computer where they are used to calculate an enthalpy for the air leaving the evaporator outlet. In an alternate embodiment of the present invention two separate sensing units can be used and simultaneously positioned over the evaporator's inlet and outlet. With this embodiment the enthalpies for both the inlet and outlet can be determined simultaneously.

For a diagnosis of the air refrigeration system, the evaporator inlet enthalpy is first compared with the evaporator outlet enthalpy in the computer. Based on this comparison, it is determined whether the total heat transfer ($Q_{TOT}$) of the evaporator is as rated by the manufacturer. If $Q_{TOT}$ is as rated, then the air flow is checked to determine whether there might be an air flow problem, such as a dirty evaporator coil. In cases where $Q_{TOT}$ is correct and there is no air flow problem, a sensible heat ratio (SHR) for the evaporator is calculated. Specifically, if both $Q_{TOT}$ and the SHR are as rated by the manufacturer, then the air refrigeration system is properly operable. On the other hand, if either $Q_{TOT}$ or the SHR are not as rated for the system, additional diagnostics involving superheat and subcool calculations need to be considered. This will involve data from the condenser. Accordingly, the enthalpies for the air entering the intake of the condenser and the air leaving through the exhaust of the condenser need to be determined and compared in a manner similar to that disclosed above for the evaporator. Thus, incidentally, the efficiency of the condenser can also be determined.

To calculate superheat for the air refrigeration system, readings of $Q_{TOT}$ for the evaporator and for the suction line temperature, $T_s$, are required. Recall, $Q_{TOT}$ for the evaporator was previously determined by calculating the change in enthalpies between the evaporator inlet and the evaporator outlet. The suction line temperature, $T_s$, is taken non-invasively off the fluid line between the evaporator coil and the compressor. The computer then uses this data to determine superheat. In a similar manner, $Q_{TOT}$ for the condenser is determined, and the liquid line temperature, $T_L$, is obtained. Specifically, the liquid line temperature, $T_L$, is taken off the fluid line between the condenser coil and the expansion valve. The computer then uses this data to determine subcool. The superheat and subcool, which are calculated as indicated above, are then compared to the rated superheat and the rated subcool for the system. If the measured superheat is lower than the rated superheat, or the measured subcool is higher than the rated subcool, the indication is that the air refrigeration system is overcharged with refrigerant. On the other hand, if the measured superheat is higher than the rated superheat, or the measured subcool is lower than the rated subcool, the indication is that the system is undercharged with refrigerant.

It is to be appreciated that the apparatus of the present invention may be either mobile or fixed base. In a mobile configuration the sensing units may be selectively positioned over the evaporator inlet or outlet. Likewise they may be selectively positioned over the condenser intake or exhaust. For the mobile configuration, the computer may also be mobile. On the other hand, for the fixed based configuration the computer can be either permanently placed on site with the sensing units or remotely positioned at a centralized location where it can monitor several systems. In either case, for the fixed base configuration, each sensing unit can be permanently positioned over a respective inlet, outlet, intake, or exhaust in the system being monitored.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
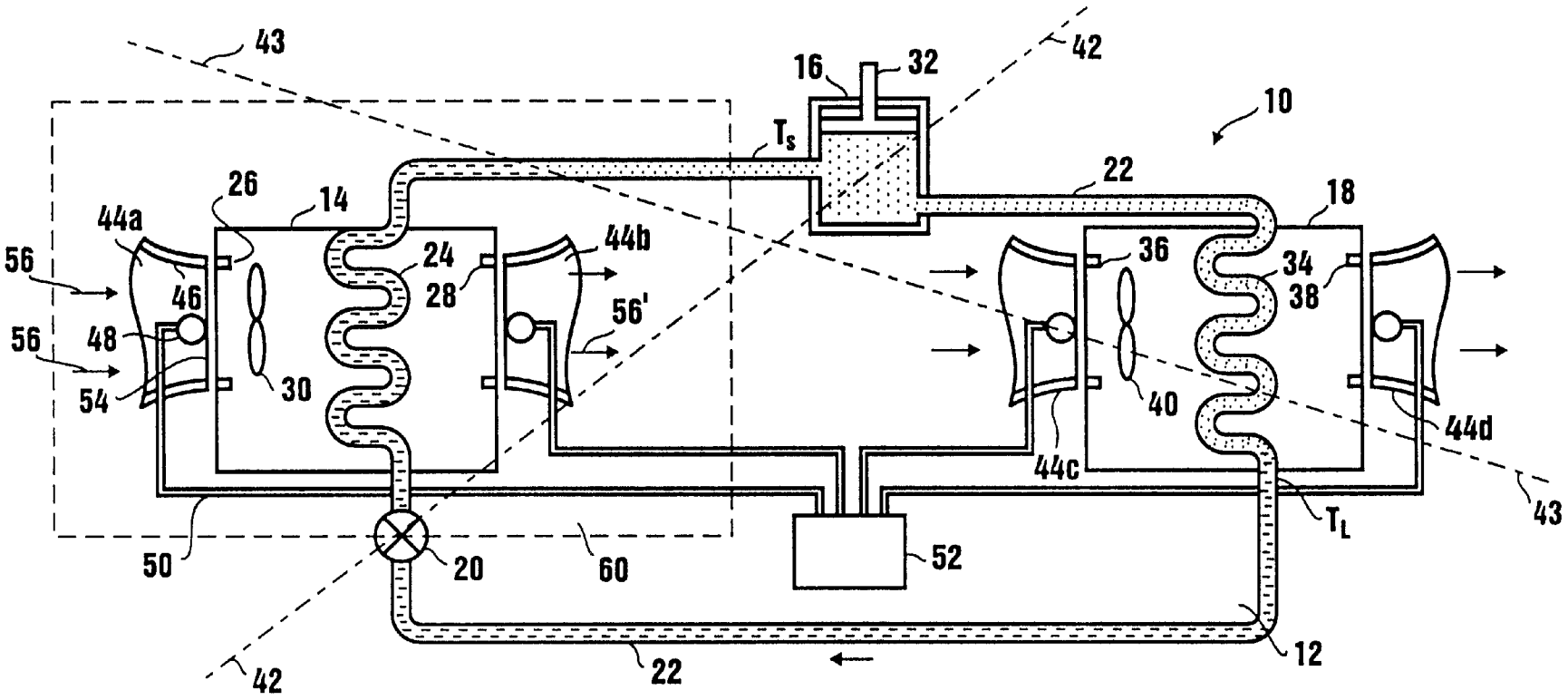
FIG. 1 is a schematic diagram of a typical air refrigeration system with air flow sensing units of the present invention positioned at predetermined critical locations in the system.

Referring initially to FIG. 1, a schematic of the apparatus in accordance with the present invention is shown in its operational environment and is generally designated 10. More specifically, the schematic of the apparatus 10 is shown in FIG. 1 superimposed over the schematic of a typical air refrigeration system 12. For purposes of the present invention it is instructive to identify the salient components of the system 12 and to briefly discuss their interactive cooperation.

In overview the air refrigeration system 12 includes an evaporator 14, a compressor 16, a condenser 18 and an expansion valve 20 which are all interconnected in a closed loop by the fluid line 22. Specifically, the evaporator 14 includes an evaporator coil 24, which is actually part of the fluid line 22. The evaporator 14 also includes and evaporator inlet 26 which directs air over the coil 24, and an evaporator outlet 28 which directs air away from the coil 24. A blower 30 is included in the evaporator 14 to cause air to flow into the evaporator 14 through the inlet 26, across the coil 24, and from the evaporator 14 through the outlet 28. Next in line along the fluid line 22 is the compressor 16. The compressor 16 is of a type well known in the pertinent art and includes a piston 32 which compresses, and thereby increases the pressure of, the fluid in fluid line 22. As shown in FIG. 1, the fluid line 22 connects the compressor 16 with the condenser 18.

The condenser 18 of air refrigeration system 12 includes a condenser coil 34 which, like the evaporator coil 24, is actually part of the fluid line 22. Additionally, the condenser 18 has an intake 36 which directs air over the coil 34, and it has an exhaust 38 which directs air away from the coil 34. Like the evaporator 14, the condenser 18 includes a blower 40 which causes air to flow into the compressor 18 through the intake 36, across the coil 34, and from the condenser 18 through he exhaust 38. Next in line along the fluid line 22 is the expansion valve 20 which is of a type well known in the art. With an opposite effect to that caused by compressor 16, the expansion valve 20 reduces pressure on the fluid in fluid line 22. Thus, in a manner well known in the pertinent art, the fluid in fluid line 22 of air refrigeration system 12 cycles through the system 12 between a high pressure condition as it passes through condenser 18, and a low pressure condition as it passes through evaporator 14. The demarcation between high and low pressure is generally indicated in FIG. 1 by the pressure line 42. High pressure in the system 12 being on the condenser 18 side of pressure line 42, and low pressure in the system 12 being on the evaporator 14 side of pressure line 42. Further, it should be noted that while under high pressure, the fluid in the fluid line 22 changes state (condenses) from a gas to a liquid. On the other hand, while at the lower pressure, the fluid in fluid line 22 changes state (evaporates) from a liquid to a gas. The demarcation between liquid and gas is generally indicated in FIG. 1 by the liquid line 43.

FIG. 1 shows there are four separate sensing units 44*a–d* which can be respectively positioned over the evaporator inlet 26, the evaporator outlet 28, the condenser intake 36 and the condenser exhaust 38. It is to be appreciated that the apparatus 10 of the present invention can include all four such sensing units 44*a–d* or, alternatively, it can include as few as one such sensing unit 44. When more than one sensing unit 44 is used, they will all be essentially identical. Therefore, only sensing unit 44*a* will be discussed here, with the understanding that in all important respects the sensing units 44*b–c* are the same as sensing unit 44*a*.

As shown in FIG. 1, sensing unit 44*a* includes an air guide 46 and a detector 48. Further, the detector 48 is electronically connected via a line 50 with a computer 52. As shown in FIG. 1, the line 50 is a hard wire connection. It will be appreciated, however, that this communication link can be an rf (radio frequency) wireless system. As for the air guide 46, it can be made of any material which will divert or direct air flow. Preferably, the air guide 46 can be made of a light weight material, such as a fabric. Regardless of the material that is used, it is necessary that the air guide 46 be formed with a port 54 which can be either selectively or permanently engaged with the evaporator 14 or the condenser 18. In FIG. 1, the sensing unit 44*a* is shown engaged with the evaporator inlet 26. As indicated above, sensing unit 44*a*, or a similar sensing unit 44, can also be engaged with evaporator outlet 28, condenser intake 36 or condenser exhaust 38.

When properly engaged with either the evaporator 14 or the condenser 18, the sensing units 44 direct air in a predetermined manner. For example, when sensing unit 44*a* is engaged with evaporator inlet 26, the air which flows through the sensing unit 44*a* (indicated by the arrows 56) is the same volume of air that flows into the evaporator 14. Also, it is the same volume of air that flows out of the evaporator 14 through evaporator outlet 28.

As also shown in FIG. 1, the detector 48 is positioned near the port 54 of sensing unit 44*a*. In one embodiment of the apparatus 10, the detector 28 is centered in the air guide 46. It happens, however, that regardless where the detector 28 is specifically located on the sensing unit 44, an important consideration is that the detector 28 be subjected to a representative sample of the air flowing through the sensing unit 44*a*. This can be done in several ways. For example, air sampling can be done by selectively positioning a plurality of individual detectors 28 in the vicinity of port 54 of the sensing unit 44, and then averaging the readings from these various detectors 28. In another manner, sampling can be done by redirecting air samples from various locations in the air guide 46 to a single detector 28. Readings are then made by the single detector 28. In all cases, the detector 28 includes a dry bulb thermometer (not shown), which is of a type well known in the pertinent art, and it includes a relative humidity meter (not shown), which is also of a type well known in the pertinent art. Additionally, the detector may include a device (not shown) for taking air flow temperature, pressure, or air flow velocity to determine the actual volumetric air flow through the sensing unit 44. Accordingly, the readings which are taken by the sensing unit 44 are the temperature and the relative humidity, and volumetric flow of the air flowing through the sensing unit 44.

For the present invention, the temperature and relative humidity readings which are obtained by the sensing unit 44 are electronically transmitted via line 50 to the computer 52. Using predetermined data evaluation programs in the computer 52, the dry bulb temperature reading and the relative humidity reading of the air flowing through the sensing unit 44 are converted into an enthalpy reading. In the case where the sensing unit 44*a* is positioned over the inlet 26 to evaporator 14, the enthalpy is determined for the air entering evaporator inlet 26. In a similar manner, respective enthalpy readings can be obtained for the evaporator outlet 28, the condenser intake 36 and the condenser exhaust 38.

Figure 2:
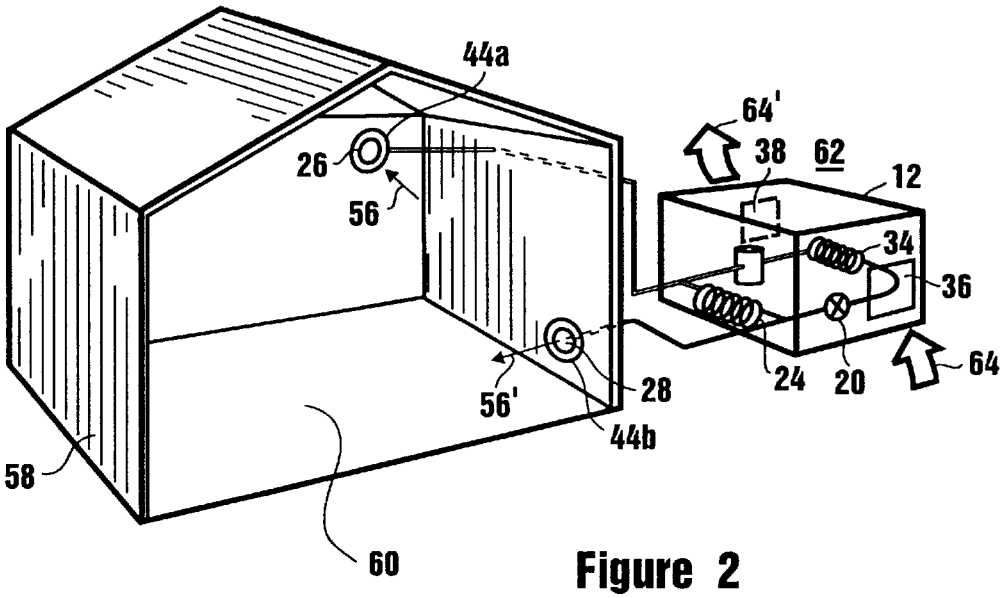
FIG. 2 is a perspective view of an environment inside a structure which is serviced by an air refrigeration system, with portions of the structure broken away for clarity.

Referring to FIG. 2 it can be seen how the apparatus 10 of the present invention may be employed. Specifically, for the structure 58, an airspace 60 is shown which is to be cooled by the air refrigeration system 12. In this environment, to evaluate and monitor the evaporator 14 of the system 12, a sensing unit 44*a* is positioned over the inlet 26 in airspace 60 which leads to the evaporator 14. This connection is sometimes referred to as the supply line. At the same time, a sensing unit 44*b* is positioned over the outlet 28 in the airspace 60 which leads from the evaporator 14. This connection is sometimes referred to as the return line. With the sensing units 44*a* and 44*b* in place, readings are taken from the air that is supplied to, and the air that is returned from, the evaporator 14. This air is respectively designated in FIG. 2 with the arrows 56 and 56'.

As also shown in FIG. 2, the condenser coil 34 of air refrigeration system 12 is immersed in a heat sink 62. Specifically, air from the heat sink 62, which is generally designated by the arrow 64, is pulled into the system 12 through intake 36 and directed over the coil 34. After receiving heat from the coil 34, this same air, now designated by the arrow 64', is returned back to the heat sink 62. As is to be appreciated with cross reference to FIG. 1, the condenser 18 can be monitored and evaluated by respectively placing sensing units 44*c* and 44*d* over its intake 36 and exhaust 38. Appropriate readings can then be taken of the air 64 and 64'.

Figure 3:
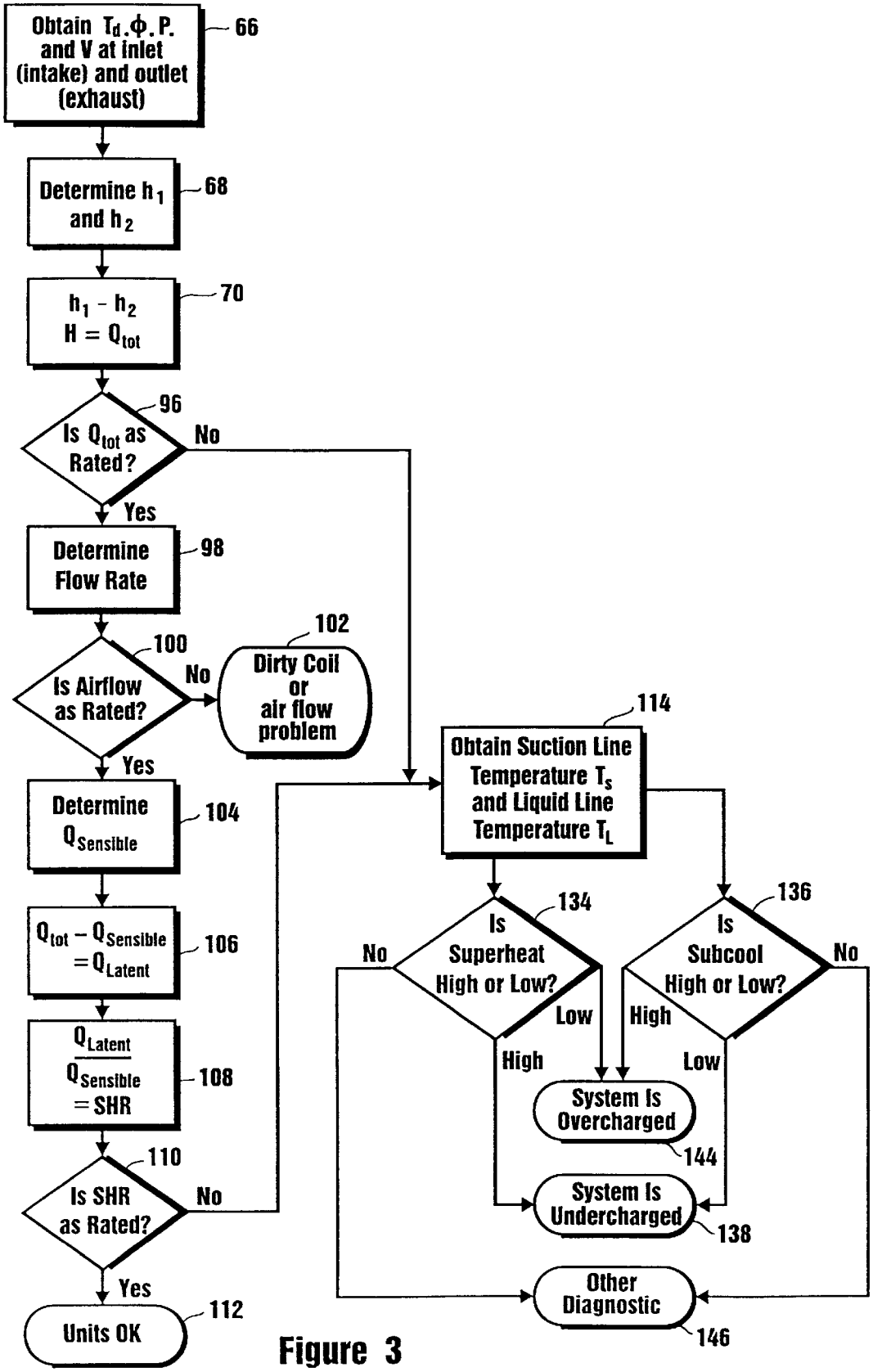
FIG. 3 is a block diagram showing a diagnostic analysis scheme as contemplated by the present invention.

The process for evaluating an air refrigeration system 12 will, perhaps, be best appreciated with reference to FIG. 3. There it will be seen, as indicated by block 66, that an evaluation starts by obtaining data in the form of various readings that are taken by the detector unit 48 of the associated sensing 44. Specifically, it is important that the dry bulb temperature, $T_d$, and the relative humidity, $\phi$, be obtained by each sensing unit 44. Additionally, barometric pressure can be easily determined and used to refine other readings, if necessary. Also, the volumetric air flow rate can be obtained. As indicated above, with these readings, air tables that are programmed into computer 52 can be used to determine the enthalpy, h, of air passing through the particular sensing unit 44. For instance, by taking separate readings of the air 56 and air 56', the enthalpy of air at inlet 26 ($h_1$) and the enthalpy of air at outlet 28 ($h_2$) can be determined. This acquisition is indicated by block 68. Block 70 next indicates that the difference between the enthalpies $h_1$ and $h_2$ is taken as the total heat, $Q_{TOT}$, which is exchanged between the conditioned air 56–56' and the evaporator coil 24. How this total heat, $Q_{TOT}$, is used, needs further evaluation in the context of the heat transfer process between air 56 and evaporator coil 24.

Figure 4A:
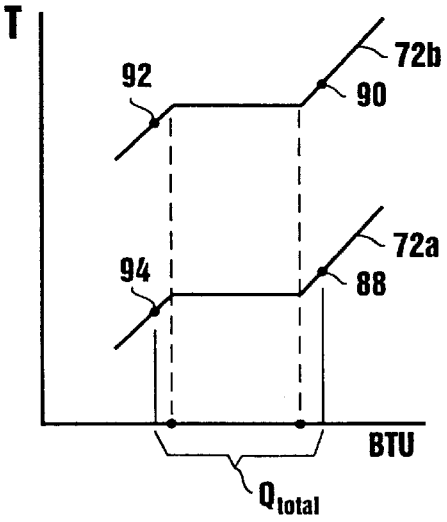
FIG. 4A is a graph showing a generalized relationship between temperature and heat for a refrigerant during its transition between a gaseous and a liquid state at different pressures.
Figure 4B:
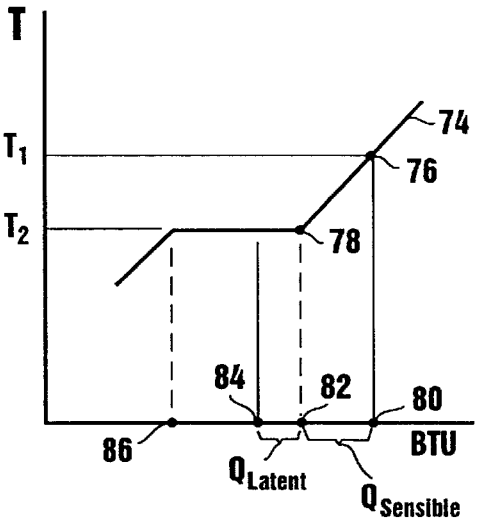
FIG. 4B is a graph showing a generalized relationship between temperature and heat for moisture during its passage over an evaporator coil of an air refrigeration system.

In order to more fully appreciate the heat transfer process that is being evaluated by the apparatus 10 of the present invention, reference is momentarily directed toward FIGS. 4A and 4B. Specifically, FIG. 4A shows the general relationship between temperature and heat for a refrigerant in the fluid line 22 of air refrigeration system 12. More specifically, line 72*a* shows a generalized temperature/heat relationship at the lower pressures experienced in fluid line 22 on the evaporator 14 side of the pressure line 42 in FIG. 1, and the line 72*b* shows a generalized temperature/heat relationship at the higher pressures experienced in fluid line 22 on the condenser 18 side of the pressure line 42. As shown, the lines 72*a* and 72*b* show temperature/heat relationships during a transition in state between gas and liquid at the different pressures. Similarly, line 74 in FIG. 4B shows a generalized temperature/heat relationship for moisture at atmospheric pressure as air transitions in state between a gas and a liquid.

In FIG. 4B it will be seen that as air decreases in temperature from $T_1$ to $T_2$, movement along the line 74 from point 76 to point 78 shows a corresponding change in the quantity of heat from point 80 to point 82. This particular quantity of heat is sensed by the temperature change from $T_1$ to $T_2$ and is, therefore, sensible heat, $Q_{sensible}$. According to FIG. 4B, a further loss of heat from point 82 to point 84 will not cause a change in temperature. Thus, this lost heat is latent heat, $Q_{latent}$. It will also be noted that a further loss of heat, e.g. past the point 86, will result in a transition from the gaseous state (to the right of point 82) to a liquid state (to the left of point 86). FIG. 4A, can be similarly analyzed for the refrigerant in line 22. FIG. 4A is, however, also instructive on the physical transitions between states for refrigerant in fluid line 22. For instance, point 88 on line 72*a* is representative of the refrigerant as it leaves the evaporator coil 24. The transition from point 88 to point 90 on line 72*b* represents the increase in pressure on the refrigerant in fluid line 22 by the action of compressor 16. As the high pressure refrigerant condenses in condenser coil 34, the loss of heat to heat sink 62 is represented by movement from point 90 to point 92. The release in pressure afforded by expansion valve 20 is indicated in FIG. 4A by a movement from point 92 on line 72*b* to the point 94 on line 72*a*. At point 94, the refrigerant is entering the evaporator coil 24. As the refrigerant moves through the evaporator coil 24, air 56 also flows over the coil 24. Consequently, heat from the air 56 is added to the refrigerant to cause movement along the line 72*a* back to the point 88. The heat transferred from air 56 is the total heat, $Q_{TOT}$, and, as stated above, $Q_{TOT}$ is equal to the difference in enthalpies $h_1$ and $h_2$. Comparing FIG. 4A with FIG. 4B, it also happens that $Q_{TOT}=Q_{sensible}+Q_{latent}$. With the above in mind, return now to FIG. 3 and reenter the process at the point where $Q_{TOT}$ for the evaporator 14 has been determined.

As indicated by block 96, the measured $Q_{TOT}$ for evaporator 14 is compared with the rated $Q_{TOT}$. Assume for the moment that the measured $Q_{TOT}$ is as rated. Blocks 98, 100 and 102 in FIG. 3, indicate that with proper $Q_{TOT}$ the volumetric air flow rate is checked and, if underrated, the conclusion to be made is that there is either a dirty coil (i.e. evaporator coil 24, or condenser coil 34, as appropriate), a dirty blower (i.e. blower 30 or 40), or a malfunctioning blower motor.

Block 104 in FIG. 3 indicates that once the total heat $Q_{TOT}$ has been determined, preprogrammed psychrometric tables in computer 52 can be used in conjunction with temperature changes (e.g. $T_1$ and $T_2$ in FIG. 4B) to determine the sensible heat, $Q_{sensible}$. With a value for $Q_{sensible}$, a sensible heat ratio, SHR, can be determined (see blocks 106 and 108). Inquiry block 110 then indicates that if the SHR is as rated for the system 12 (usually equal to or greater than 90%), then (as indicated in conclusion block 112) the system 12 is OK. No further testing is then necessary. On the other hand, if conclusion block 112 can not be reached, i.e. $Q_{TOT}$ or SHR are not as rated, further analysis of the system 12 should be made.

To make an additional evaluation of the system 12, block 114 requires that the suction line temperature $T_S$ and liquid line temperature $T_L$ be determined. With reference back to FIG. 1 it will be seen that the suction line temperature, $T_S$, is preferably taken on the fluid line 22 at the inlet to compressor 16. Also, FIG. 1 indicates that the liquid line temperature, $T_L$, is preferably taken on the fluid line 22 at the side of the condenser coil 34 that is opposite the compressor 16. The suction line temperature $T_S$ and the liquid line temperature $T_L$ can then be respectively used with the changes in enthalpies at the condenser coil 34 and the evaporator coil 24 to determine set points for superheat and subcool of the system 12. In the context of the present invention, the concepts of superheat and subcool will, perhaps, be best appreciated with reference to FIG. 5.

Figure 5:
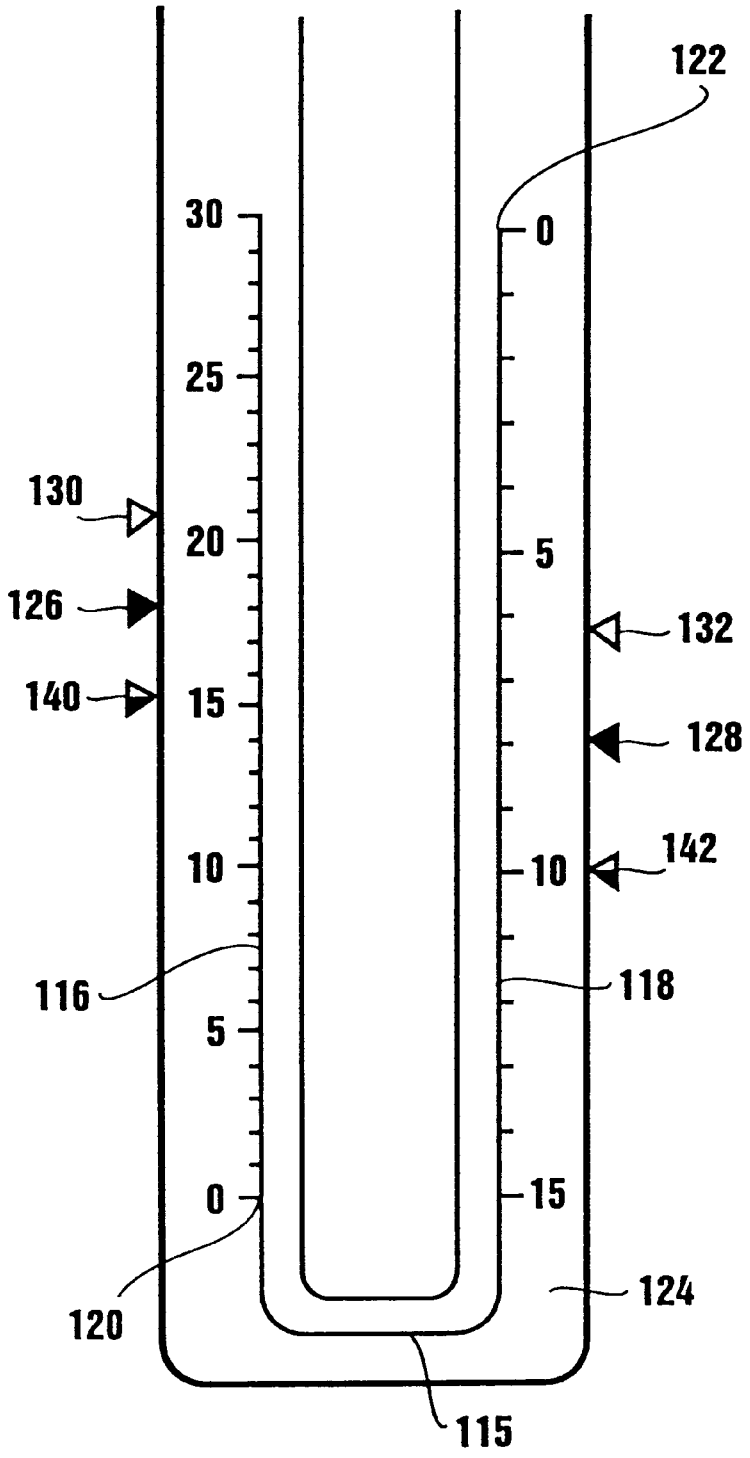
FIG. 5 is a specialized graph showing the interation between superheat and subcool relative to their respective saturation points.

In FIG. 5 it will be seen that a continuous scale 115 is provided which is actually two interconnected and mutually dependent scales. These interconnected scales are actually a representative superheat scale 116 and a representative subcool scale 118. Further, a saturation point 120 (0° F.) is shown for superheat scale 116, and a saturation point 122 (0° F.) is shown on the subcool scale 118. As shown, the continuous scale 115 is mounted on a base 124 such that the saturation point on the subcool scale 118 is aligned with approximately 30° F. on the superheat scale 116. It is to be appreciated that any movement of superheat scale 116 on base 124 results in a simultaneous and corresponding movement of the subcool scale 118, and vice versa. With this in mind, consider that the scale 115, is positioned on base 124 in FIG. 5 (as stated above), so as to correspond with a particular ambient temperature. Parenthetically, although not considered in this analysis, if the ambient temperature changes, the location of the combined scale 115 will move accordingly on the base 124 (i.e. 0° F. subcool will no longer be aligned with 30° F. superheat).

For a properly operating air refrigeration system 12, at a particular ambient temperature, the system 12 will have a particular rated superheat temperature, and a particular rated subcool temperature. For example, in FIG. 5, the rated superheat temperature might be 18° F., as indicated by the solid arrowhead 126 on superheat scale 116 (this is a set point). Also, in this example, the corresponding factory rated subcool temperature might be 8° F., as indicated by the solid arrowhead 128 on subcool scale 118 (this is another set point). These, of course, are the expected readings which will be obtained if the system 12 is operating properly under predicted conditions for temperature ($T_d$) and pressure.

At this point it is important to note that for an operator to obtain the superheat and subcool readings for an operating system 12, the operator needs to obtain the suction line temperature $T_S$ and liquid line temperature $T_L$ as indicated in block 114 of FIG. 3. Further, using calculations known in the pertinent art, $T_S$ and $T_L$ can be evaluated with the changes in enthalpies (i.e. $Q_{TOT}$) and calculated by computer 52 to obtain measured operational readings for the superheat and subcool of the system 12. The measured superheat and measured subcool then need to be respectively compared with the rated superheat and the rated subcool for system 12 (see blocks 134 and 136). For instance, consider that the readings obtained indicate a superheat of 21° F., as indicated by clear arrowhead 130 on superheat scale 116, and a subcool of 6° F., as indicated by clear arrowhead 132 on subcool scale 118. Decision blocks 134 and 136 show that these particular conditions are indicative of an undercharge in the freon (see block 138). On the other hand, if the obtained readings are, respectively, 15° F., as indicated by the divided arrowhead 140 on superheat scale 116, and 10° F. as indicated by the divided arrowhead 142 on subcool scale 118, then block 144 shows that the system 12 is overcharged.

As shown in FIG. 3, it may happen that while $Q_{TOT}$ or SHR may not be as rated for system 12, the measured superheat and subcool may, nevertheless, be as rated. If so, block 146 indicates some additional testing or inspection must be done. Specifically, but only by way of example, there may be leaks in the system 12 which have been undetected, or the compression ratio of the compressor 16 may be off.

While the particular apparatus for non-invasively diagnosing a closed air refrigeration system as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An apparatus for noninvasively diagnosing a closed air refrigeration system, the system having an evaporator with an inlet and an outlet and a condenser with an intake and an exhaust, the apparatus comprising:

a sensor means for measuring enthalpy components, wherein said enthalpy components include dry bulb temperature and relative humidity;

a computer means electrically connected with said sensor means for calculating an inlet enthalpy from the measured components when said sensor means is placed near said evaporator inlet, and calculating an outlet enthalpy from the measured components when said sensor is placed near said evaporator outlet, and comparing said inlet enthalpy with said outlet enthalpy to determine a total heat transfer ($Q_{TOT}$) for use in diagnosing said refrigeration system.

2. An apparatus as recited in claim 1 wherein said computer means calculates an intake enthalpy from the measured components when said sensor is placed near said condenser intake and an exhaust enthalpy from the measured components when said sensor is placed near said condenser exhaust and wherein said computer means compares said intake enthalpy with said exhaust enthalpy for diagnosing said refrigeration system.

3. An apparatus as recited in claim 2 wherein said sensor means is selectively positionable near said evaporator inlet, said evaporator outlet, said condenser intake, and said condenser exhaust.

4. An apparatus as recited in claim 2 wherein said sensor means comprises:

an inlet sensing unit positioned near the evaporator inlet for measuring said evaporator inlet enthalpy components;

an outlet sensing unit positioned near the evaporator outlet for measuring said evaporator outlet enthalpy components;

an intake sensing unit positioned near the condenser intake for measuring a condenser intake enthalpy components; and an exhaust sensing unit positioned near the condenser exhaust for measuring a condenser exhaust enthalpy components.

5. An apparatus as recited in claim 1 wherein said computer means compares said inlet enthalpy with said outlet enthalpy simultaneously.

6. An apparatus as recited in claim 1 wherein said apparatus further includes an instrument means for measuring barometric pressure, and said computing means is connected to said instrument means for using said barometric pressure measurement to calculate said enthalpies.

7. An apparatus as recited in claim 1 wherein said computer means uses respective said enthalpies to calculate a sensible heat ratio.

8. An apparatus for non-invasively diagnosing a closed air refrigeration system, the system having an evaporator with an inlet and an outlet and a condenser with an intake and an exhaust, the apparatus comprising:

a sensing unit selectively positioned near the evaporator inlet for measuring an inlet enthalpy at the evaporator inlet, and near the evaporator outlet for measuring an outlet enthalpy at the evaporator outlet; and a computer means in communication with said sensing unit to compare said inlet enthalpy with said outlet enthalpy to determine a total heat transfer ($Q_{TOT}$) for use in diagnosing said refrigeration system.

9. An apparatus as recited in claim 8 wherein said sensing unit measures a dry bulb temperature and a relative humidity.

10. An apparatus as recited in claim 8 wherein said computer means compares said inlet enthalpy with said outlet enthalpy to calculate a sensible heat ratio for the evaporator.

11. An apparatus as recited in claim 8 wherein said sensing unit is an inlet sensing unit positioned near the evaporator inlet and said apparatus further comprises an outlet sensing unit positioned over the evaporator outlet, and wherein said inlet enthalpy and said outlet enthalpy are measured simultaneously by said respective sensing units.

12. An apparatus as recited in claim 11 further comprising:

an intake sensing unit positioned near the condenser intake for measuring an intake enthalpy at the condenser intake;

an exhaust sensing unit positioned near the condenser exhaust for measuring an exhaust enthalpy at the condenser exhaust; and a connection for placing said computer means in communication with said intake sensing unite and with said exhaust sensing unit to compare said intake enthalpy with said exhaust enthalpy for diagnosing said refrigeration system.

13. An apparatus as recited in claim 12 wherein all said sensing units measure a dry bulb temperature and a relative humidity to calculate a respective enthalpy.

14. An apparatus as recited in claim 13 wherein said computer means compares said evaporator inlet enthalpy with said evaporator outlet enthalpy to calculate a sensible heat ratio for the evaporator and said computer compares said condenser intake enthalpy with said condenser exhaust enthalpy to calculate a sensible heat ratio for the condenser.

15. A method for non-invasively diagnosing a closed air refrigeration system, the system having an evaporator with an inlet and an outlet and a condenser with an intake and an exhaust, the method comprising the steps of:

positioning a sensing unit near the evaporator inlet;

measuring an enthalpy at the evaporator inlet with said sensing unit;

positioning said sensing unit near the evaporator outlet;

measuring an enthalpy at the evaporator outlet with said sensing unit; and comparing said evaporator inlet enthalpy with said evaporator outlet enthalpy to determine a total heat transfer ($Q_{TOT}$) to diagnose said system.

16. A method as recited in claim 15 further comprising the steps of:

positioning a sensing unit near the condenser intake;

measuring an enthalpy at the condenser intake with said sensing unit;

positioning said sensing unit near the condenser exhaust;

measuring an enthalpy at the condenser exhaust with said sensing unit; and comparing said condenser intake enthalpy with said condenser exhaust enthalpy to diagnose said system.

17. A method as recited in claim 16 wherein said sensing unit comprises an evaporator inlet sensor and an evaporator outlet sensor, and wherein said evaporator inlet enthalpy and said evaporator outlet enthalpy are measured simultaneously.

18. A method as recited in claim 17 wherein said sensing unit further comprises a condenser intake sensor and a condenser exhaust sensor, and wherein said condenser intake enthalpy and said condenser exhaust enthalpy are measured simultaneously.

19. A method as recited in claim 18 wherein all said sensing units measure a respective dry bulb temperature and a respective relative humidity.

20. A method as recited in claim 16 wherein said comparing steps are accomplished using a computer means to calculate a sensible heat ratio of the evaporator and a sensible heat ratio for the condenser.

21. A method as recited in claim 15 wherein said comparing step is comprises the steps of:

subtracting evaporator outlet enthalpy from said evaporator inlet enthalpy to determine a measured heat transfer; and evaluating said measured heat transfer with a rated heat transfer for said system to diagnose said system.

22. A method as recited in claim 21 further comprising the steps of:

determining a measured sensible heat ratio for said system; and comparing said measured sensible heat ratio with a rated sensible heat ratio for said system to diagnose said system.

23. A method as recited in claim 21 further comprising the steps of:

taking a suction line temperature and a liquid line temperature;

using said suction line temperature and said liquid line temperature to calculate a measured superheat and a measured subcool for said system; and comparing said measured superheat with a rated superheat for said system, and said measured subcool with a rated subcool for said system to diagnose said system.

* * * * *